US006123743A

United States Patent [19]

Carman et al.

[11] Patent Number: 6,123,743

[45] **Date of Patent: *Sep. 26, 2000**

[54] GLASS-CERAMIC BONDED ABRASIVE TOOLS

[75] Inventors: Lee A. Carman, Worcester; Shuyuan Liu, Shrewsbury, both of Mass.

[73] Assignee: Norton Company, Worcester, Mass.

[ * ] Notice: This patent is subject to a terminal disclaimer.

[21] Appl. No.: 08/192,088

[22] Filed: Feb. 4, 1994

Related U.S. Application Data

[63] Continuation of application No. 08/189,396, Jan. 28, 1994, abandoned, which is a continuation-in-part of application No. 07/892,493, Jun. 3, 1992, Pat. No. 5,318,605, which is a continuation of application No. 07/704,165, May 22, 1991, abandoned, which is a continuation-in-part of application No. 07/638,262, Jan. 7, 1991, abandoned.

[51] Int. Cl.[7] ..... B24D 3/18; C04B 35/111

[52] U.S. Cl. ..... 51/307; 51/308; 51/309; 501/7; 501/32

[58] Field of Search ..... 51/307, 308, 309; 501/732

[56] References Cited

U.S. PATENT DOCUMENTS

| | | | |
|---|---|---|---|
| 4,314,827 | 2/1982 | Leitheiser et al. | 51/298 |
| 4,543,107 | 9/1985 | Rue | 51/309 |
| 4,623,364 | 11/1986 | Cottringer et al. | 51/309 |
| 4,744,802 | 5/1988 | Schwabel | 51/309 |
| 4,749,665 | 6/1988 | Yano et al. | 501/32 |
| 4,820,660 | 4/1989 | Mohri et al. | 501/8 |
| 4,857,486 | 8/1989 | Ebata et al. | 501/21 |
| 4,898,597 | 2/1990 | Hay et al. | 51/298 |
| 4,906,255 | 3/1990 | Nikitina et al. | 51/307 |
| 4,919,991 | 4/1990 | Gadkaree | 428/113 |
| 4,968,327 | 11/1990 | Efros et al. | 51/309 |
| 4,997,461 | 3/1991 | Markhoff-Matheny | 51/309 |

OTHER PUBLICATIONS

*Journal of the British Ceramic Society*, "The Strength of Experimental Grinding Wheel Materials including Use of Novel Glass and Glass–Ceramic Bonds" by T.I.Barry, L.A. Lay, R.Morrell. Issue 79, p. 139–145, 1980, no month.

*American Ceramic Society Bulletin*, "A Novel Technique for Producing a Glass–Ceramic Bond in alumina Abrasives" by Terrence J. Clark and James S. Reed. Issue 65 (11) pp. 1506–1512 (1986) no month.

*Primary Examiner*—Karl Group

*Attorney, Agent, or Firm*—Mary E. Porter; Brian M. Kolkowski

[57] ABSTRACT

The present invention provides an abrasive tool that comprises sol-gel alumina abrasive grains bonded together by a glass-ceramic bond material, the tool comprising from about 35 to 65% by volume void spaces, wherein at least about 75% of the volume of the bond material is located in the bond posts or in a coating on the abrasive grains and in which the volume proportion of bond to grain is from about 0.06 to 0.6.

7 Claims, No Drawings

GLASS-CERAMIC BONDED ABRASIVE TOOLS

CROSS REFERENCE TO RELATED APPLICATIONS

This application is a continuation of U.S. patent application Ser. No. 08/189,396 filed Jan. 28, 1994, now abandoned which is a continuation of U.S. patent application Ser. No. 07/892,493 (now issued U.S. Pat. No. 5,318,605) filed Jun. 3, 1992, which is a continuation of U.S. patent application Ser. No. 07/704,165 (now abandoned) filed May 22, 1991, which is a continuation-in-part of U.S. patent application Ser. No. 07/638,262 (now abandoned) filed Jan. 7, 1991.

BACKGROUND OF THE INVENTION

1. Field of the Invention

The invention relates to bonded sol-gel alumina abrasive tools and particularly those bonded with a bond material that can be converted to a semi-crystalline ceramic bond.

2. Technology Review

A vitreous bonded abrasive product, such as a conventional grinding wheel, comprises three volume components: an abrasive particulate material which usually occupies about 35 to 50 volume %; a vitreous bond material that provides typically about 5 to 15 volume % of the total; and the balance of the volume is void space. The function of the bond material is to hold the abrasive particles in place so that they can do the abrading work. In a typical vitreous bonded product of the prior art the glass components are added to the abrasive particles and the mixture is heated till the glass components melt, fuse to form a glass, and then flow to the particle contact points to form a bond post that solidifies on cooling. This provides the rigid structure of the finished product. In a more recent method the glass bond material is formed separately as a molten mass, cooled to solidify and then ground up. This ground up material, know as a frit, is then mixed with the abrasive particles. The advantage of this procedure is that the heating step can be shortened, the bond composition is more uniform and the forming temperature can often be reduced.

It will be appreciated that the rigidity and strength of the products of the prior art are often determined by the bond posts. Glass, being an amorphous material, has a low strength, (about 40 to about 70 Mpa), by comparison with the abrasive particles. This low strength gives rise to premature release of grain and enhanced wear. Hence the grinding ability of vitreous bonded products is in theory limited by the strength of the posts. In practice, with most abrasives, such limitations were not very significant. Some more modern abrasives such as sol-gel alumina abrasives however are adapted to perform best under a heavy load and this puts the bond under considerable stress. Traditional glass bonds are often found inadequate under such conditions and there is therefore a need for vitreous based bonds with a greater ability to operate under high stresses.

It has been proposed that there might be advantage in the use of a glass-ceramic bond to bond abrasives. However it has not been found possible heretofore to ensure that the bond material is concentrated in the bond posts or in coating the abrasive grits. This of course is extremely inefficient and has not resulted in any commercialization of such glass-ceramic bonded materials in spite of the potential advantages that might be expected.

For example, Clark et al. proposed this in a paper entitled "A Novel Technique for Producing a Glass-Ceramic Bond in Alumina Abrasives", Am. Ceram. Soc. Bull., 65 [11] 1506-12 (1986). Clark et al. indicated that most glass-ceramic bonds tested lacked sufficient flow and spreading to bond well to alumina. For the one bond in Clark which achieved what was termed "a good degree of flow", the result was an abrasive product with a diametrical strength of only approximately 60% of the level for abrasive products made with conventional glass bonds.

The present invention provides significantly improved bond material which performs unexpectedly well when used in combination with sol-gel alumina abrasives. It has significantly greater strength than traditional bonds and is easily formed. Abrasive products comprising sol-gel alumina abrasives and such bond materials perform unexpectedly better than those made with prior art bonds or glass-ceramics and conventional abrasives. The bonds further can be used with a wide variety of abrasives and exhibit an impressive versatility in the kinds of abrasive products that can be made with them.

SUMMARY OF THE INVENTION

The present invention provides an abrasive tool that comprises sol-gel alumina abrasive grains bonded together by a glass-ceramic bond material, the tool comprising from about 35 to 65% by volume void spaces, wherein at least about 75% of the volume of the bond material is located in the bond posts or in a coating on the abrasive grains and in which the volume proportion of bond to grain is from about 0.06 to 0.6.

DETAILED DESCRIPTION OF THE INVENTION

The present invention provides a bonded sol-gel alumina abrasive product which comprises abrasive particles held together by a glass-ceramic bond material wherein at least 75% of the bond material is present in the form of bond posts or a coating on the abrasive particles. The grinding performance of the bonded sol-gel alumina abrasive products held together by the glass-ceramic bond material is unexpectly high in comparison to the grinding performance of conventional abrasives held together by the same glass-ceramic bond material.

The sol-gel alumina abrasive grains can be seeded or unseeded. The aluminous bodies may be prepared by a sol-gel technique which entails crushing or extruding, and then firing a dried gel prepared from a hydrated alumina such as microcrystalline boehmite, water, and an acid such as nitric acid. The intial sol may further include up to 10–15% by weight of spinel, mullite, manganese dioxide, titania, magnesia, ceria, zirconia powder or a zirconia precursor which can be added in larger amounts. These additives are normally included to modify such properties as fracture toughness, hardness, friability, fracture mechanics, or drying behavior. In its most preferred embodiment, the sol or gel includes a dispersed submicron crystalline seed material or a precursor thereof in hydrated alumina particles to alpha alumina upon sintering. Suitable seeds are well-known in the art. The amount of seed material should not exceed about 10 weight % hydrated alumina, and there is normally no benefit to amounts in excess of 5%. If the seed is adequately fine (preferably about 60 $m^2$ per gram or more), amounts of from about 0.5 to 10% may be used, with about 0.5 to 5% being preferred. The seeds may also be added in the form of a precursor such as ferric nitrate solution. In general, the seed material should be isostructural with alpha alumina and have similar crystal lattice dimensions (within about 15%), and should be present in the dried gel at the temperatures at which the conversion to alpha alumina occurs (about 1000° C. to 1100° C.). The preparation of suitable gels, both with and without seeds, is well-known in the art, as are the processing procedures, such as crushing, extruding, and firing. Thus, further details thereon are readily available in the literature and are not included here.

Each aluminous body so prepared is made up essentially of numerous alpha alumina crystals having crystal sizes of less than about 10 micrometers, and preferably less than about 1 micrometer. The abrasive has a density of at least 95% of theoretical density.

Glass-ceramic materials are defined for the purposes of this specification as materials that are processed and formed as glasses but which, on heating, can be converted to a semi-crystalline vitreous bond material with a crystallinity from trace amounts to nearly 100% by volume. Preferably, the crystallinity is from trace amounts to about 40% by volume of the glass-ceramic, more preferably between from trace amounts to about 30% by volume, and most preferably between from trace amounts to about 20% by volume. The grain size (longest dimension) of the crystals in the glass-ceramic are preferably less than about 10 microns and more preferably less than about 1 micron.

The glass-ceramic can be tailored to the sol-gel alumina abrasive particle by controlling the crystallinity, the bond properties including the coefficient of thermal expansion can be tailored to match the properties of the abrasive particles resulting in optimum performance. Preferably, the coefficient of thermal expansion is within 20% of that of the abrasive and more preferably within 10% of that of the abrasive. This may often result in reduced thermal stresses within the structure and consequently enhanced strength. While such a match of expansion coefficients may often be desirable, it is not an essential feature of the broadest aspect of this invention. The degree of crystallinity can be adjusted to approach that of the mechanical strength of the bond with the sol-gel alumina abrasive particles or to ensure that the particles release when they have been smoothed and cease to cut effectively.

The use of glass-ceramic bonds in a vitreous bonded abrasive wheel enables the wheel to be operated at higher rotational speeds because of the greater mechanical strength of the wheel. In addition it permits the use of less bond material to achieve a comparable level of performance as can be obtained with conventional vitreous bonded materials. The greater bond strength also results in better corner holding and overall a significantly improved wheel by comparison with the prior art wheels made with conventional vitreous bonds.

The physical mechanism by which these results are obtained is not completely understood but it is thought to be related to the fracture mechanism in glasses. In an amorphous structure crack propagation is uninhibited by intervening structures and so the crack propagates until it reaches a surface and the glass breaks. In a glass-ceramic however the microcrystals dispersed in the glass matrix appear to cause crack branching which limits propagation and thus maintains the integrity of the structure far longer. Additionally, crystals may form along the glass/abrasive interface providing a "root" to enhance the grain retention.

Glass-ceramic compositions tend to nucleate and crystallize at high viscosities and this tends to arrest deformation and densification. The selection of the components is therefore a matter of great importance. The key parameters are that the glass must flow, wet the abrasive particles, and form dense bond posts before, or at least concurrent with, the onset of crystallization. The flow properties are particularly important so as to ensure that the bond material in the final product is located in the bond posts or in a coating on the abrasive grits rather than in separated non-functional areas of the bonded material. In the present invention at least about 75% and preferably at least about 85% or higher, is present in these locations, indicating that the desired degree of flow and coating has been achieved.

In the production of a glass-ceramic bonded abrasive tool, the components are melted into a glass which is then cooled and ground to a powder, preferably one with a particle size of about 200 mesh or finer. In general, the finer the powder the better. This is because the surfaces of the particles present a plurality of potential surface nucleation sites and the greater the surface area of the glass powder, the larger the number of sites at which the desirable crystallinity can be initiated. The glass powder is then mixed with the abrasive in the requisite proportions along with any temporary binders, plasticizers and the like that may be desired. This mixture is then formed into a bonded abrasive product using conventional equipment. The critical parameter that determines the degree of crystallinity or often the lack thereof, (apart from the composition), is the firing schedule. This varies with the composition of the glass-ceramic and controls not only the degree of crystallinity but also the size of the crystals and ultimately the properties of the glass-ceramic. The firing schedule is often, but not essentially, a multi-step operation. In a typical schedule the dense glass bond posts are formed at an optimal temperature that is determined by the glass components. The product is then brought to the optimal nucleation temperature, (usually from about 30° C. below, to about 150° C. above the annealing temperature), for a fixed time, followed by a period at the optimal crystal growth temperature. As an alternative, with certain glass formulations, it is possible to carry out simultaneous nucleation and crystal growth at the bond post formation temperature.

This procedure gives rise to dense glass-ceramic bond posts that have significantly greater strengths than those of conventional glass bonds.

In some cases it is possible to provide that the crystalline material separating from the glass melt is itself an abrasive and contributes to the abrasive properties of the final product. In an extreme situation this separating abrasive material is the sole abrasive component of the mixture such that the abrasive is, so to speak, generated "in situ". In such an event however the desirable porosity of the abrasive composite must be supplied by other means such as sacrificial components, blowing agents or the like.

In order that persons in the art may better understand the practice of the present invention, the following Examples are provided by way of illustration, and not by way of limitation. Additional background information known in the art may be found in the references and patents cited herein, which are hereby incorporated by reference.

EXAMPLES

The production of a bonded product according to the invention is further illustrated with reference to the following Examples.

Example 1

A glass-ceramic bond material was made by preparing a metal borate glass powder having the composition shown in Table I below. The glass was obtained from Corning Incorporated. The composition information included below was derived from that source.

TABLE I

| | Composition (#) | | |
|---|---|---|---|
| | 1 (wt %) | 2 (wt %) | 3 (wt %) |
| CaO | 25.4 | 24.8 | 26.5 |
| $B_2O_3$ | 47.3 | 46.1 | 52.6 |
| $SiO_2$ | 27.2 | 13.2 | 11.3 |
| F | — | — | 5.0 |
| MgO | — | 4.5 | — |
| SrO | — | 11.4 | — |
| $Al_2O_3$ | — | — | 9.6 |

Table I records several glass forming compositions, expressed in terms of parts by weight on the oxide basis, illustrating the glass-ceramics. Because it is not known with which cation(s) the fluoride is combined in the glass, it is simply reported as fluoride as being in excess of the oxide components. However, inasmuch as the sum of all the components, including the fluoride totals or closely approximates 100 percent, for all practical purposes the tabulated individual values may be considered to represent a weight percent. The actual batch ingredients may comprise any materials, either oxides or other compounds, which, when melted together with one another, will be transformed into the desired oxide in the proper proportions. For example, $Li_2CO_3$ can conveniently constitute the source of $Li_2O$ and $CaF_2$ can be used to supply the fluoride content. Colemanite can be used as a batch material to provide CaO and $B_2O_3$.

The batch materials were compounded, ballmilled together to assist in achieving a homogeneous melt, and charged into platinum crucibles. After placing lid thereon, the crucibles were placed into a furnace operating at a temperature of about 1500° C. and maintained therewithin for about two hours.

To reduce time and energy necessary to comminute the glass to finely-divided particles, the melts were poured as fine streams into a bath of tap water. This procedure, termed "drigaging" in the glass art, breaks up the stream of molten glass into small fragments which can thereafter be milled to a desired particle size. Another technique for accomplishing the same purpose involves running a stream of molten glass between metal rollers to form a thin ribbon of glass which can then be crushed and milled to a desired particle size. Both methods were employed in the laboratory work. In each instance the glasses were milled to an average particle size of 10 microns.

It will be recognized that the above description of mixing, melting, and forming procedures reflects laboratory activity only and that the glass compositions operable in the subject invention are capable of being processed employing mixing, melting, and forming procedures conventionally utilized in commercial glass making. That is, it is only necessary that the batch components be thoroughly blended together, melted at a sufficiently high temperature for a sufficient length of time to secure a homogeneous melt, and subsequently made into a frit.

Example 2

The glass powders of Example 1 were mixed both with seeded and unseeded sol-gel alumina abrasives manufactured by Norton Company and 3M Company, respectively, and sold under the tradenames of SG and 321, respectively. Both the seeded and unseeded sol-gel alumina abrasive were 80 grit. Also mixed into the blend were bond (either the standard Norton commercial HA4C bond or one of the three bond compositions shown in Table I) ethylene glycol, water, dextrin, liquid binder and/or animal glue as shown in Table II.

TABLE II

| | Seeded Sol-gel Alumina | | | | Unseeded Sol-gel Alumina | | | |
|---|---|---|---|---|---|---|---|---|
| | | #1 | #2 | #3 | HA4C | #1 | #2 | #3 |
| | HA4C | | (parts) | | | | (parts) | |
| Abrasive | 100 | 100 | 100 | 100 | 100 | 100 | 100 | 100 |
| Bond | 13.6 | 10.4 | 11.1 | 10.0 | 13.6 | 10.4 | 11.1 | 10.0 |
| Dextrin | 1.2 | 2.8 | 2.8 | 2.8 | 1.2 | 2.8 | 2.8 | 2.8 |
| Water | — | 0.5 | 0.5 | 0.5 | — | 0.5 | 0.5 | 0.5 |
| Animal Glue | — | 2.0 | 2.0 | 2.0 | — | 2.0 | 2.0 | 2.0 |
| Ethylene glycol | 0.14 | 0.1 | 0.1 | 0.1 | 0.14 | 0.1 | 0.1 | 0.1 |
| Liquid binder | 2.0 | — | — | — | 2.0 | — | — | — |

The same volume percent of bond and sol-gel alumina abrasive was used to produce a wheel of the same grade using the commercial bond as the wheel of the invention using the glass-ceramics listed above.

The mixture was then pressed into grinding wheels with a 5 inch outside diameter, a ⅞ inch inside diameter and ½ inches thick. The green wheels were then fired according to one of the three following firing cycles, see Table III.

TABLE III

| | Firing Schedule | |
|---|---|---|
| | A | B |
| Ramp | 100° C./hr | 100° C./hr |
| Soak | 900° C. × 8 hrs | 900° C. × 4 hrs |
| Ramp | cool to RT | cool to 700° C. |
| Soak | | 700° C. × 4 hrs |
| Ramp | | cool to RT |

The grinding wheels were tested for grinding ratio and power consumption. The grinding ratio was measured in controlled feed grinding with coolant using the outer diameter of the wheel. The wheel speed was approximately 9000 surface feet per minute. The material ground for Example 2 was 52100 steel and the material ground for Example 3 was M7 steel. The infeed was 80 mils on diameter for 52100 Steel and 40 mils on diameter for M7 Steel. The work speed was 150 rpm. The width of the grind was 0.25 inches in the center of the wheel face. The same grinding technique was used to obtain all of the grinding data in Examples 3 and 4.

The results indicate that there is an unexpected improvement in grinding ratio using the sol-gel alumina abrasive and glass-ceramic combination over that of conventional abrasives with glass-ceramics as shown in Table IV.

TABLE IV

| | G-ratio | Power (HP/in) |
|---|---|---|
| SG/HA4C Commercial Bond | 150.7 | 8.7 |
| SG/#1 Glass-ceramic Bond | 192.7 | 10.3 |
| SG/#2 Glass-ceramic Bond | 186.5 | 10.0 |

TABLE IV-continued

| | G-ratio | Power (HP/in) |
|---|---|---|
| SG/#3 Glass-ceramic Bond | 256.6 | 9.0 |
| 321/HA4C Commercial Bond | 164.0 | 4.7 |
| 321/#1 Glass-ceramic Bond | 211.3 | 5.1 |
| 321/#2 Glass-ceramic Bond | 170.7 | 5.0 |
| 321/#3 Glass-ceramic Bond | 189.4 | 4.8 |

Example 3

A glass-ceramic similar to the glass-ceramic described in the Clark reference was produced for use as an abrasive bond. The glass-ceramic bond formulation was produced by batching the raw materials common in the industry which are described in Table V. The new bond had a pre-fired composition of 13.36 wt % Kentucky Ball Clay #6, 18.72 wt % K200 Feldspar, 9.02 wt % SS-65, 11.32 wt % silex flint, 34.85 wt % wollastonite, 1.57 wt % boric acid, 6.27 wt % zinc oxide, and 4.87 wt % barium carbonate.

TABLE V

| | $SiO_2$ wt % | $Al_2O_3$ wt % | $Na_2O$ wt % | $K_2O$ wt % | $B_2O_3$ wt % | MgO wt % | CaO wt % | Impurities wt % | LOI wt % |
|---|---|---|---|---|---|---|---|---|---|
| Kentucky Ball Clay #6 | 63.8 | 23.1 | .21 | .41 | | .28 | .1 | 3.4 | 8.7 |
| K200 Feldspar | 67.4 | 18.3 | 3.5 | 10.0 | | .01 | .26 | .05 | .5 |
| SS-65 Sodium Silicate | 76.2 | | 23.8 | | | | | | |
| Silex Flint | 99.6 | .2 | | | | .01 | .01 | | .13 |
| Wollastonite | 50.9 | .2 | | | | .1 | 46.9 | .8 | 1.1 |
| Boric Acid | | | | | 56.3 | | | | 43.7 |
| Zinc Oxide | (100% ZnO) | | | | | | | | |
| Barium Carbonate | (77.8 percent BaO) | | | | | | | | 22.2 |

The raw materials were weighed out into 2.5 lb batches, and the batches were blended in a vibratory mixer with 1 inch rubber balls for 15 minutes. A platinum crucible preheated to 1400° C. was then charged with equal portions of the batch of approximately 450 grams every 20 minutes to prevent foaming over a period of 2.5 hours. After the last charge, the melt was held for 1 hour at 1400° C. The melt was then poured into a water bath quenching the glass. The drigage was removed from the water and dried at 100° C. The drigage was fritted to −12 mesh by crushing the drigage in a VD type pulverizer made by Bico Inc. of Burbank, Calif. The −12 mesh frit was then dry ball milled for 6 hours in an $Al_2O_3$ ball mill using ¾ inch high density $Al_2O_3$ media, 2 ml of isopropyl alcohol per 750 grams of frit, and a 6:1 media to frit ratio. The frit after firing had the composition of 17.0 mole % CaO, 7.0 mole % $Al_2O_3$, 59.0 mole % $SiO_2$, 6.5 mole % ZnO, 4.0 mole % BaO, 3.0 mole % $Na_2O$, 2.0 mole % $K_2O$ and 1 mole % $B_2O_3$ which is similar to the Clark Bond #4 in the Clark paper entitled "A Novel Technique for Producing a Glass-Ceramic Bond in Alumina Abrasives", Am. Ceram. Soc. Bull., 65 [11] 1506-12 (1986).

Five 5 inch wheels were produced both with the above glass-ceramic frit and Norton's standard commercial HA4C glass bond for comparison. The samples were formed from a mix of glass frit, abrasive and other additives. Further, two abrasives (Norton's 60 grit seeded sol-gel alumina abrasive and 60 grit 25A alumina abrasive) were compared. The mixes were formed with the following compositions listed in Table VI.

TABLE VI

| | Seeded Sol-gel Alumina | | | Conventional 25A Alumina | | |
|---|---|---|---|---|---|---|
| | HA4C | #3 (parts) | Clark | HA4C | #3 (parts) | Clark |
| Abrasive (60 grit) | 100 | 100 | 100 | 100 | 100 | 100 |
| Bond | 15.3 | 14.3 | 14.9 | 15.1 | 14.1 | 14.7 |
| Dextrin | 0.7 | 2.2 | 2.2 | 0.7 | 2.2 | 2.2 |
| Water | — | 0.2 | 0.2 | — | 0.2 | 0.2 |
| Animal Glue | — | 3.0 | 3.0 | — | 3.0 | 2.0 |
| Ethylene glycol | 0.1 | 0.2 | 0.2 | 0.1 | 0.2 | 0.2 |
| Liquid binder | 2.1 | — | — | 2.1 | — | — |

The mixes were mixed in a Model N-50 mixer manufactured by Hobart of Troy, Ohio. The mixes were then screened through a −16 mesh screen. The mix was then pressed in a closed mold of a set volume to create wheels and test bars. The 3 inch wheels were made for a diametric compression test (mold volume of 74.61 cc and thickness of 0.630 inches), the 5 inch wheels were made for OD grinding tests (mold volume of 171.12 cc and thickness of 0.525 inches), and test bars were made for a modulus of rupture test (mold volume of 33.17 cc and dimensions of 4 inches by 1 inches by 0.5 inches). The wheels and test bars were fired in a furnace in an air atmosphere. The wheels and test bars were fired at approximately 1100° C. for 5 hours, then the furnace was cooled to 630° C. and held for 1 hour before returning to room temperature.

The grinding performance was determined by using the grinding test described in Example 2. Grinding performance was measured on M7 steel using a low metal removal rate. The results are shown in Tables VII.

TABLE VII

| | G-ratio | Power (HP/in) |
|---|---|---|
| SG/HA4C Commercial Bond | 3.7 | 10.3 |
| SG/#3 Glass-ceramic Bond | 4.4 | 9.0 |
| SG/Clark Bond | 3.5 | 10.0 |
| Alumina/HA4C Commercial Bond | 4.6 | 7.8 |
| Alumina/#3 Glass-ceramic Bond | 4.6 | 8.5 |
| Alumina/Clark Bond | 4.3 | 9.0 |

The grinding results show that the Clark bonded grinding wheels perform rather poorly in comparison with the glass-ceramic bonded grinding wheels of the present invention or even when compared with conventional glass bonded grinding wheels. Further, the results show an unexpected improvement in G-ratio when using a glass-ceramic in combination with a sol-gel alumina abrasive in comparison to those of a glass-ceramic conventional abrasive combination.

What is claimed is:

1. An abrasive tool that comprises sol-gel alumina abrasive grains bonded together by a glass-ceramic bond material, the tool comprising from about 35 to 65% by volume void spaces, wherein at least about 75% of the volume of the bond material is located in the bond posts or in a coating on the abrasive grains and in which the volume proportion of bond to grain is from about 0.06 to 0.6.

2. An abrasive tool according to claim 1 in which at least about 85% of the bond material is located in bond posts or in a coating on the abrasive grains.

3. An abrasive tool according to claim 1 in which the glass-ceramic comprises an amount up to about 40% by volume of crystalline material.

4. An abrasive tool according to claim 1 in which the volume proportion of bond to grain is from about 0.1 to 0.4.

5. An abrasive tool according to claim 1 in which the abrasive grains comprise an alpha alumina with an average microcrystalline size of less than one micron.

6. An abrasive tool according to claim 1 in which the bond material is formed from a calcium boro-silicate.

7. An abrasive tool according to claim 1 in which the glass-ceramic and the abrasive grains have coefficients of thermal expansion that are within about 20% of each other.

* * * * *